US008062053B2

(12) United States Patent
Dooley et al.

(10) Patent No.: US 8,062,053 B2
(45) Date of Patent: Nov. 22, 2011

(54) ELECTRICAL CONNECTOR WITH OFFSET LATCH

(75) Inventors: Christine Anne Dooley, Lewisville, NC (US); Paul John Pepe, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 61 days.

(21) Appl. No.: 12/605,778

(22) Filed: Oct. 26, 2009

(65) Prior Publication Data

US 2011/0097942 A1 Apr. 28, 2011

(51) Int. Cl.
*H01R 13/627* (2006.01)

(52) U.S. Cl. ..... 439/354; 439/680

(58) Field of Classification Search ..... 439/344, 439/676, 354, 358, 680, 350, 357
See application file for complete search history.

(56) References Cited

U.S. PATENT DOCUMENTS 4,997,386 A * 3/1991 Kawachi et al. ..... 439/352
5,308,260 A * 5/1994 Johnston et al. ..... 439/344
5,591,042 A * 1/1997 Takata et al. ..... 439/354
5,655,934 A * 8/1997 Gow et al. ..... 439/676
5,743,755 A * 4/1998 Aoki ..... 439/354
5,752,858 A * 5/1998 Gow et al. ..... 439/676
5,785,546 A * 7/1998 Hamai et al. ..... 439/354
6,179,643 B1 * 1/2001 Fukuda ..... 439/358
6,341,974 B1 * 1/2002 Konoya ..... 439/352
6,558,197 B1 * 5/2003 Chen et al. ..... 439/607.21
6,863,554 B1 * 3/2005 Glad ..... 439/344
6,863,556 B2 * 3/2005 Viklund et al. ..... 439/354
6,960,025 B2 11/2005 Gurreri
7,063,554 B2 * 6/2006 Kuiken et al. ..... 439/352
7,083,459 B1 * 8/2006 Wu et al. ..... 439/354
7,118,286 B2 10/2006 Gurreri et al.
7,182,523 B2 2/2007 Abendschein et al.
7,207,724 B2 4/2007 Gurreri
7,325,976 B2 2/2008 Gurreri et al.
7,402,068 B1 * 7/2008 Tarchinski ..... 439/350

* cited by examiner

*Primary Examiner* — Tulsidas C Patel
*Assistant Examiner* — Phuong T Nguyen

(57) ABSTRACT

A receptacle connector is configured to mate with a plug connector having a latch member. The receptacle connector includes a housing having a mating end, an opening extending into the housing through the mating end, and a latch wall. The opening is configured to receive the plug connector therein through the mating end of the housing. The opening is at least partially defined by the latch wall. The latch wall extends a length into the housing along a central longitudinal latch wall axis. The latch wall includes a latch element extending a length along a central longitudinal latch element axis. The central longitudinal latch element axis is offset along the latch wall from the central longitudinal latch wall axis. The latch element is exposed within the opening and cooperates with the latch member of the plug connector to latch the plug connector to the housing when the plug connector is received within the opening of the housing. A contact is held within the housing. The contact has a mating interface exposed within the opening of the housing for electrically connecting to the plug connector when the plug connector is received within the opening of the housing.

19 Claims, 10 Drawing Sheets

ELECTRICAL CONNECTOR WITH OFFSET LATCH

BACKGROUND OF THE INVENTION

The subject matter described and/or illustrated herein relates generally to electrical connectors, and, more particularly, to electrical connectors having keying features for providing discriminating access to the connector.

It may be desirable to limit user access in data networks for security or other purposes. Specifically, it is becoming more popular to provide buildings with a plurality of data networks, in which each network typically corresponds to a different group of authorized users. With this new development comes the need to restrict access to a particular data network to just a particular group of authorized users. While restrictions have often been achieved in the past using software approaches, such as passwords, physical barriers are beginning to be used to restrict access to networks. Specifically, some connectors are provided with mechanical keying features such that only mating connectors that include complementary keying features can be mated with the connector. For example, a connector may include one or more extensions that are received within corresponding slots within the mating connector, and/or may include one or more slots that receive corresponding extensions of the mating connector. The size, shape, location, and/or the like of the keying features can be varied for different connectors to provide a variety of different possible configurations of keying features. Different configurations of keying features can be used for different networks to limit access of each different network to a different group of authorized users. However, because the size of many connectors is limited, there may only be limited space within and/or on the connector for the keying features. Accordingly, there may only be a limited number of different configurations of the keying features.

A need remains for an electrical connector having a greater number of different configurations of keying features than at least some known electrical connectors.

BRIEF DESCRIPTION OF THE INVENTION

In one embodiment, a receptacle connector is provided. The receptacle connector is configured to mate with a plug connector having a latch member. The receptacle connector includes a housing having a mating end, an opening extending into the housing through the mating end, and a latch wall. The opening is configured to receive the plug connector therein through the mating end of the housing. The opening is at least partially defined by the latch wall. The latch wall extends a length into the housing along a central longitudinal latch wall axis. The latch wall includes a latch element extending a length along a central longitudinal latch element axis. The central longitudinal latch element axis is offset along the latch wall from the central longitudinal latch wall axis. The latch element is exposed within the opening and cooperates with the latch member of the plug connector to latch the plug connector to the housing when the plug connector is received within the opening of the housing. A contact is held within the housing. The contact has a mating interface exposed within the opening of the housing for electrically connecting to the plug connector when the plug connector is received within the opening of the housing.

In another embodiment, a plug connector is provided. The plug connector is configured to mate with a receptacle connector having a latch element. The plug connector includes a housing including a plug having a latch wall. The plug is configured to be received within the receptacle connector. The latch wall extends a length along a central longitudinal latch wall axis. The latch wall includes a latch member extending a length along a central longitudinal latch member axis. The central longitudinal latch member axis is offset along the latch wall from the central longitudinal latch wall axis. The latch member cooperates with the latch element of the receptacle connector to latch the receptacle connector to the housing when the receptacle connector receives the plug therein. A contact is held by the housing. The contact has a mating interface extending along the plug of the housing for electrically connecting to the receptacle connector when the receptacle connector receives the plug therein.

DETAILED DESCRIPTION OF THE INVENTION

Figure 1:
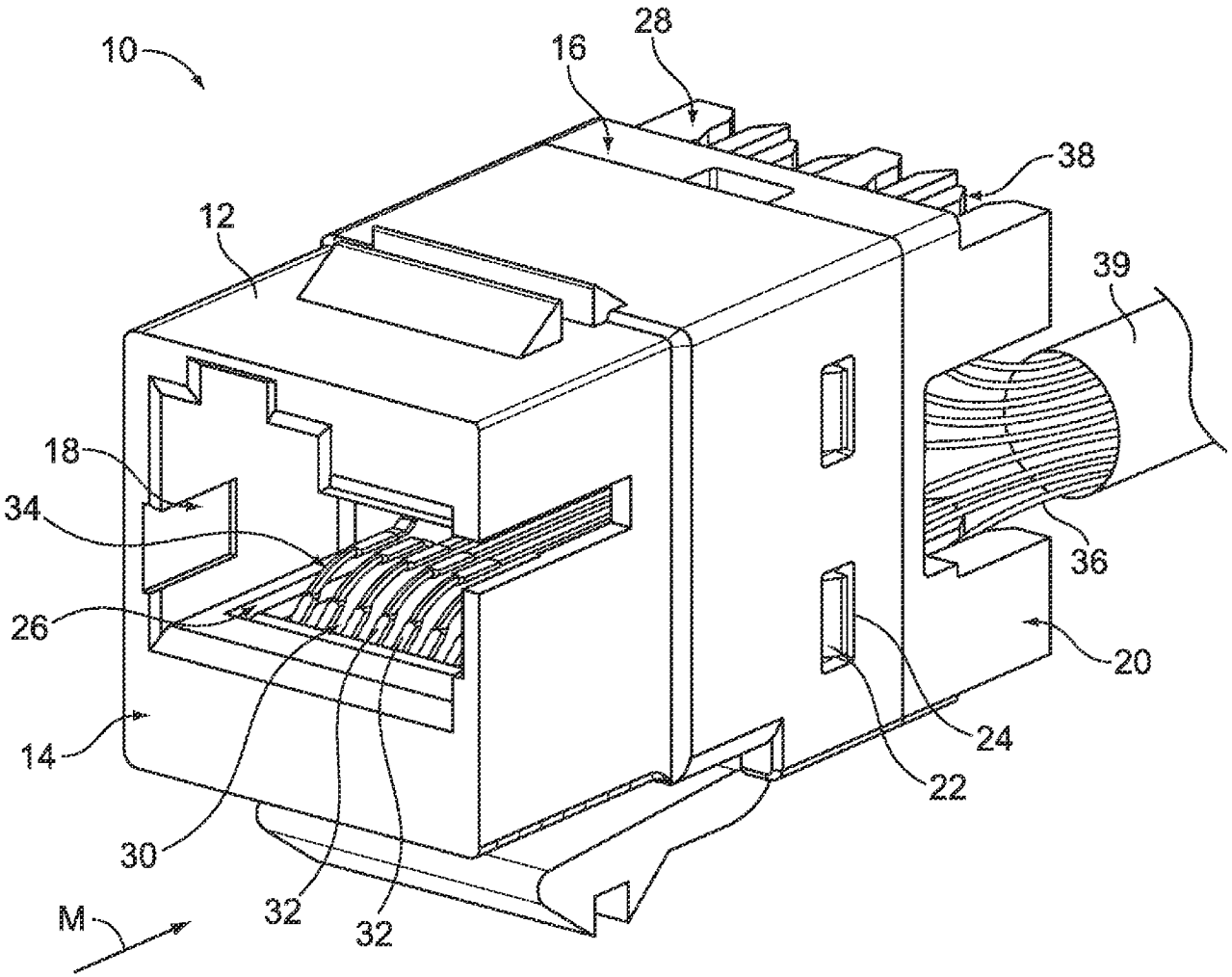
FIG. 1 is perspective view of a receptacle connector in accordance with an exemplary embodiment of the present invention.
Figure 10:
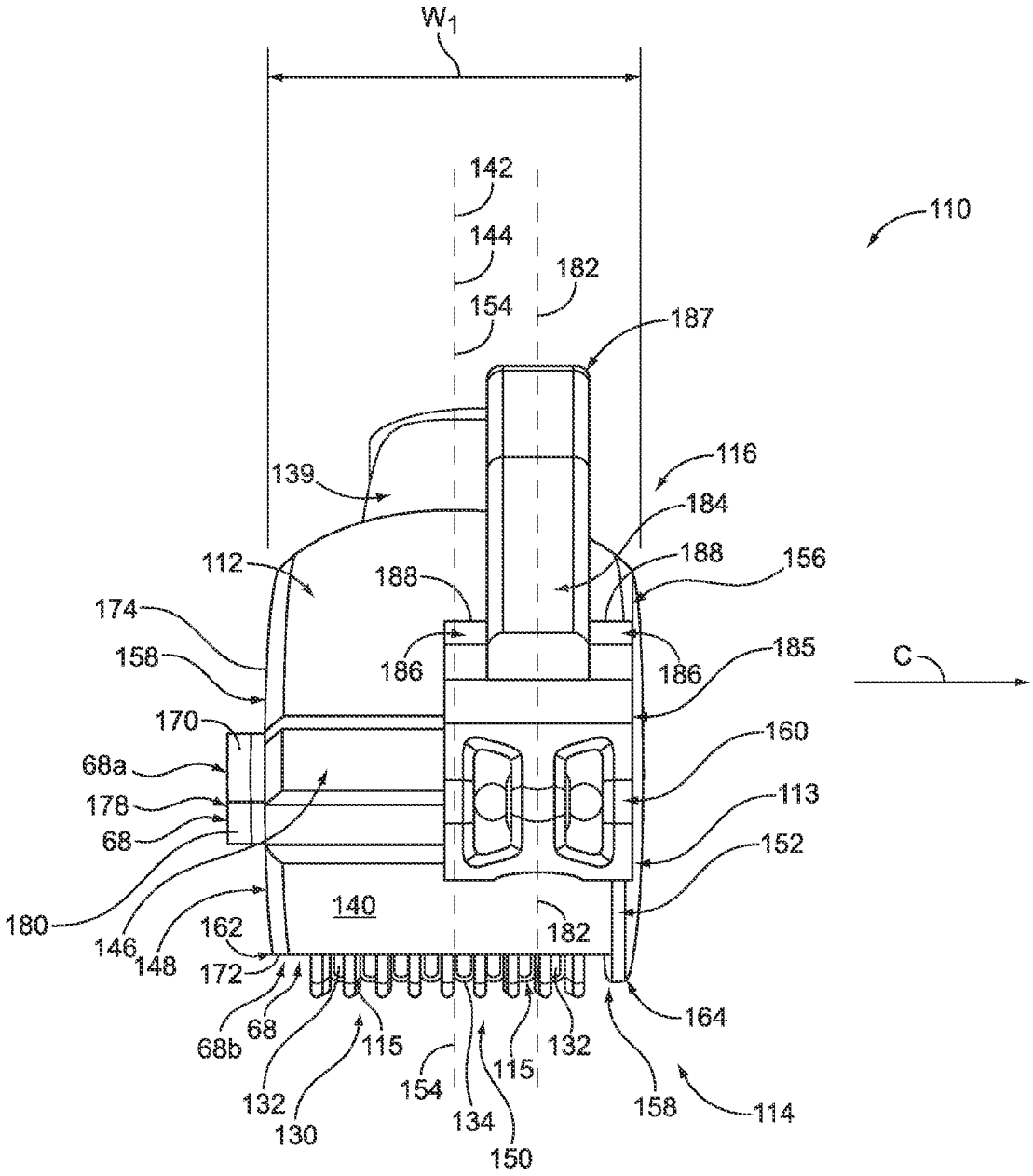
FIG. 10 is a perspective view of an exemplary embodiment of a plug connector.

FIG. 1 is perspective view of a receptacle connector 10 in accordance with an exemplary embodiment of the present invention. In the exemplary embodiment, the receptacle connector 10 is a modular connector, such as, but not limited to, an RJ-45 outlet or jack. However, the receptacle connector 10 may be any other type of receptacle connector. The receptacle connector 10 is configured to mate with a plug connector 110 (FIG. 10). Specifically, the plug connector 110 is loaded into the receptacle connector 10 along a mating direction, shown generally by the arrow M. The receptacle connector 10 includes a housing 12 extending a length from a mating end 14 to a terminating end 16, or more specifically from a front face 40 of the mating end 14 to an end surface 47 of the terminating end 16. The housing 12 includes an opening 18 extending between the mating end 14 and the terminating end 16. The opening 18 receives the plug connector 110 through the mating end 14 of the housing 12.

The receptacle connector 10 includes a contact sub-assembly 20 received within the housing 12 through the terminating end 16 of the housing 12. In the exemplary embodiment, the contact sub-assembly 20 is secured to the housing 12 via tabs 22 that cooperate with corresponding openings 24 within the housing 12. The contact sub-assembly 20 extends from a mating end 26 to a terminating end 28. The contact sub-assembly 20 is held within the housing 12 such that the mating end 26 of the contact sub-assembly 20 is positioned proximate the mating end 14 of the housing 12. The terminating end 28 of the contact sub-assembly 20 extends outward from the terminating end 16 of the housing 12. The contact sub-assembly 20 includes an array 30 of electrical contacts 32. Each electrical contact 32 within the array 30 includes a mating interface 34 exposed within the opening 18. Each mating interface 34 engages a corresponding electrical contact 132 (FIG. 10) of the plug connector 110 when the plug connector 110 is mated with the receptacle connector 10. The arrangement of the electrical contacts 32 may be controlled by industry standards, such as, but not limited to, IEC 60603-7. In an exemplary embodiment, the receptacle connector 10 includes eight electrical contacts 32 arranged as differential pairs. However, the receptacle connector 10 may include any number of electrical contacts 32, whether or not the electrical contacts 32 are arranged in differential pairs.

In the exemplary embodiment, a plurality of wires 36 are attached to terminating portions 38 of the contact sub-assembly 20. The terminating portions 38 are located at the terminating end 28 of the contact sub-assembly 20. Each terminating portion 38 is electrically connected to a corresponding one of the electrical contacts 32, for example via an optional circuit board (not shown) of the contact sub-assembly 20. The wires 36 extend from a cable 39 and are terminated to the terminating portions 38. Optionally, the terminating portions 38 include insulation displacement connections (IDCs) for terminating the wires 36 to the contact sub-assembly 20. Alternatively, the wires 36 may be terminated to the contact sub-assembly 20 via a soldered connection, a crimped connection, and/or the like. In the exemplary embodiment, eight wires 36 arranged as differential pairs are terminated to the receptacle connector 10. However, any number of wires 36 may be terminated to the receptacle connector 10, whether or not the wires 36 are arranged in differential pairs. In the exemplary embodiment, each wire 36 is electrically connected to a corresponding one of the electrical contacts 32 via the corresponding terminating portion 38 and the circuit board. Accordingly, the receptacle connector 10 provides electrical signal, electrical ground, and/or electrical power paths between the plug connector 110 and the wires 36 via the electrical contacts 32, the circuit board, and the terminating portions 38. Alternatively, the receptacle is mounted on, and electrically connected to, a circuit board (not shown).

Figure 2:
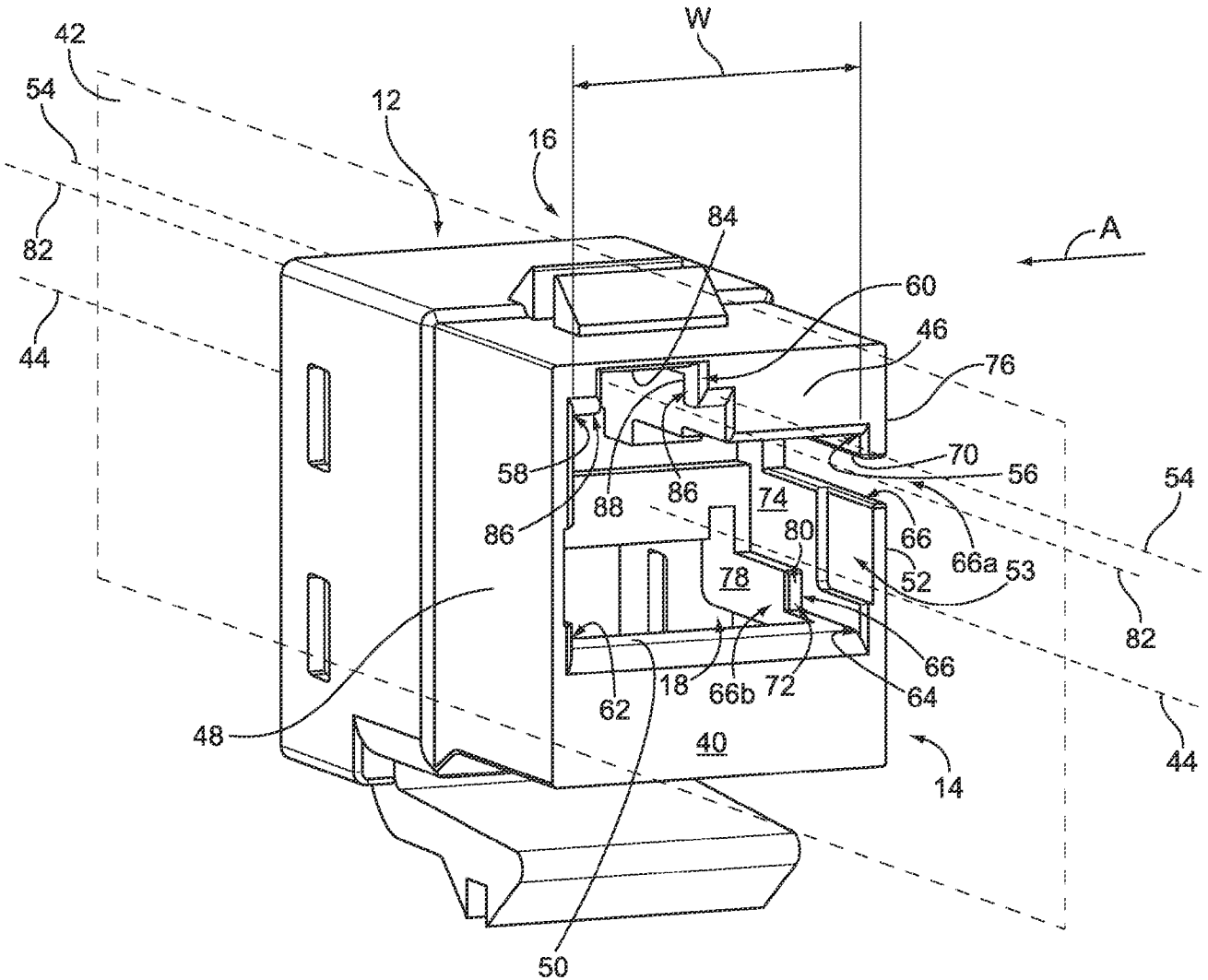
FIG. 2 is a front perspective view of an exemplary embodiment of a housing of the receptacle connector shown in FIG. 1.
Figure 3:
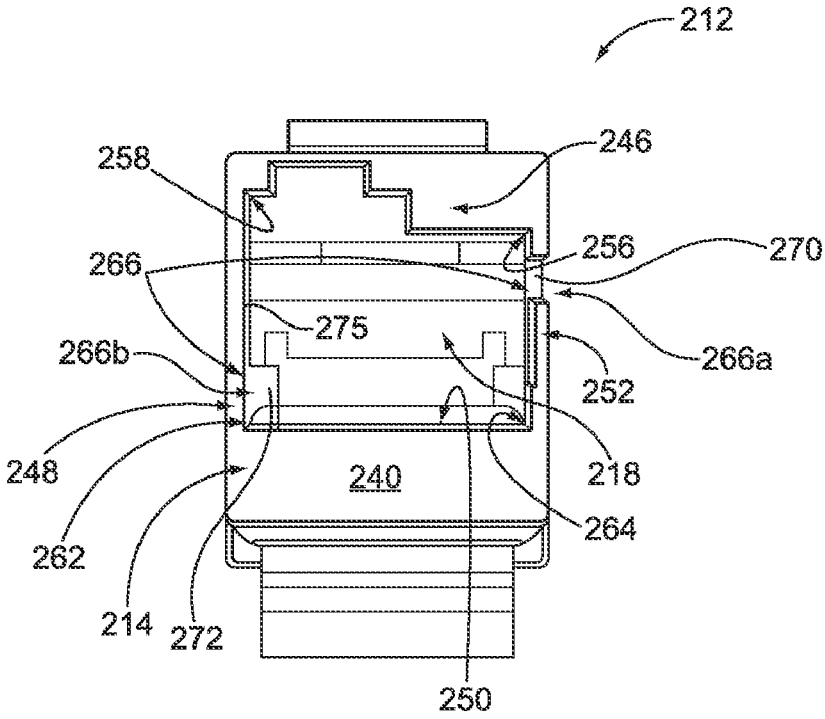
FIG. 3 is a front elevational view of an exemplary alternative embodiment of a receptacle connector housing illustrating an exemplary alternative configuration of keying elements.

FIG. 2 is a perspective view of an exemplary embodiment of the housing 12 of the receptacle connector 10 (FIG. 1). The housing 12 includes the opening 18, which extends through the mating end 14 of the housing 12. Specifically, the opening 18 extends through the front face 40 of the mating end 14 of the housing 12. The opening 18 extends a length longitudinally along a central longitudinal plane 42 and along a central longitudinal axis 44 that lies within, and extends parallel to, the central longitudinal plane 42. In some embodiments, the opening 18 extends completely through the length of the housing 12 from the front face 40 to the end surface 47. In other embodiments, the opening 18 extends through only a portion of the length of the housing 12, specifically from the front face 40 toward the end surface 47 along only a portion of the length of the housing 12. The opening 18 is defined by one or more walls of the housing 12. In the exemplary embodiment, the opening 18 is defined by four walls, specifically a latch wall 46 and three side walls 48, 50, and 52. In other words, each of the latch wall 46 and the side walls 48, 50, and 52 forms a portion of a boundary of the opening 18. The latch wall 46 extends a length longitudinally from the front face 40 toward the terminating end 16 of the housing 12. In some embodiments, the latch wall 46 extends the length from the front face 40 all the way to the end surface 47 of the terminating end 16 of the housing 12. In other embodiments, the latch wall 46 extends along only a portion of the length of the housing 12; specifically the latch wall 46 extends the length from the front face 40 toward the end surface 47 along only a portion of the length of the housing 12. The latch wall 46 extends the length along a central longitudinal axis 54. The latch wall 46 extends an interior width W from an interior edge 56 to an opposite interior edge 58. The latch wall 46 includes a latch element 60 that cooperates with a latch member 160 (FIG. 10) of the plug connector 110 (FIG. 10) to latch the connectors 10 and 110 together. The central longitudinal axis 54 of the latch wall 46 may be referred to herein as a "central longitudinal latch wall axis".

In the exemplary embodiment, each of the side walls 48, 50, and 52 extends a length from the front face 40 all the way to the end surface 47 of the terminating end 16 of the housing 12. In other embodiments, the side walls 48, 50, and/or 52 extend from the front face 40 toward the end surface 47 along only a portion of the length of the housing 12. The side wall 48 extends an interior width from the edge 58 of the latch wall 46 to an interior edge 62. The side wall 50 extends an interior width from the edge 62 to an interior edge 64. The side wall 52 extends an interior width from the edge 64 to the edge 56 of the latch wall 46. The side wall 48 and/or the side wall 52 optionally includes a recess 53 for receiving a tab (not shown) of a ground shield (not shown) that may optionally surround at least a portion of the housing 12. In the exemplary embodiment, the opening 18 is defined by the four walls 46, 48, 50, and 52 such that the opening 18 generally includes a rectangular shape at the mating end 14 of the housing 12. In addition or alternatively to the rectangular shape, the opening 18 may include any other shape for receiving any shaped plug (such as, but not limited to, the plug 113 (FIG. 10) of the plug connector 110, and/or the like) therein. Moreover, in the exemplary embodiment, the walls 46 and 50 extend approximately parallel to each other, the walls 48 and 52 extend approximately parallel to each other, and the walls 46 and 50 extend approximately perpendicular to the walls 48 and 52. Alternatively, each of the walls 46, 48, 50, and 52 extend at any other angle relative to each of the other walls 46, 48, 50, and 52.

The latch element 60 of the latch wall 46 extends a length along a central longitudinal axis 82. In the exemplary embodiment, the central longitudinal axis 82 of the latch element 60 extends approximately parallel to the central longitudinal axis 54 of the latch wall 46. Alternatively, the central longitudinal axis 82 extends at any other angle relative to the central longitudinal axis 54 of the latch wall 46. The latch element 60 is exposed within the opening 18. In the exemplary embodiment, the latch element 60 includes a slot 84 that extends within the latch wall 46 and is exposed within the opening 18. Specifically, the slot 84 extends a length, along the central longitudinal axis 82 thereof, through the front face 40 and into the latch wall 46 toward the terminating end 16 of the housing 12. In the exemplary embodiment, the slot 84 includes a pair of ledges 86 that are each exposed within the opening 18. Each ledge 86 engages a corresponding shoulder 186 (FIG. 10) of the latch member 160 (FIG. 10) of the plug connector 110 (FIG. 10) to latch the connectors 10 and 110 together. Specifically, each ledge 86 includes a latching surface 88 that engages a corresponding latching surface 188 of the latch member 160. Although two ledges 86 are shown, the slot 84 may include any number of ledges 86 for engaging any number of shoulders 186 of the plug connector 110. In addition or alternative to the slot 84, the latch element 60 may include any other structures and/or the like, such as, but not limited to, an extension (not shown) extending into the opening 18, and/or the like. The central longitudinal axis 82 of the latch element 60 may be referred to herein as a "central longitudinal latch element axis".

As can be seen in FIG. 2, the central longitudinal axis 82 of the slot 84 is offset along the latch wall 46 from the central longitudinal axis 54 of the latch wall 46. Specifically, in the exemplary embodiment, the central longitudinal axis 82 of the slot 84 is offset from the central longitudinal axis 54 of the latch wall 46 along the interior width W of the latch wall 46 in the direction of the arrow A. In other words, the central longitudinal axis 82 of the slot 84 is offset along the latch wall 46 from the central longitudinal plane 42 of the opening 18, in the direction A, such that the central longitudinal axis 82 of the slot 84 extends closer to one of the edges 56 or 58 of the latch wall 46 than to the other edge 56 or 58. In the exemplary embodiment of FIG. 2, the central longitudinal axis 82 of the slot 84 extends closer to the edge 58 of the latch wall 46 than to the edge 56 of the latch wall 46.

The housing 12 of the receptacle connector 10 (FIG. 1) includes one or more optional keying elements 66 that cooperate with one or more optional keying members 68 (FIG. 10) of the plug connector 110. The keying elements 66 facilitate providing discriminating access to the receptacle connector 10. Specifically, the keying elements 66 facilitate preventing some plug connectors from mating with a specific receptacle connector 10. In other words, only specific predetermined plug connectors can be fully received within the housing opening 18 and electrically connected to the electrical contacts 32 (FIG. 1) of a specific receptacle connector 10. For example, the keying elements 66 may prevent plug connectors having keying members that are not complementary with the keying elements 66 of the receptacle connector 10 (e.g., keying members having different sizes, shapes, locations, and/or the like relative to the keying elements 66) from be fully received within the housing opening 18 and electrically connected to the electrical contacts 32. Plug connectors having keying members that are complementarily sized, shaped, located, and/or the like relative to the keying elements 66 can be fully received within the housing opening 18 and electrically connected to the electrical contacts 32.

The receptacle connector housing 12 includes two keying elements 66*a* and 66*b* in the exemplary embodiment. However, the receptacle connector housing 12 may include any number of the keying elements 66. In the exemplary embodiment, the side wall 52 of the housing 12 includes the keying element 66*a* and the keying element 66*b*. Specifically, the keying element 66*a* includes a slot 70 that extends through the side wall 52, and the keying element 66*b* includes an extension 72 extending from the side wall 52. The slot 70 extends a length, along the central longitudinal axis 44 of the opening 18, through the front face 40 and toward the terminating end 16 of the housing 12. The slot 70 extends within the side wall 52 at a location on the side wall 52 that is closer to the edge 56 of the latch wall 46 than to the edge 64 of the side wall 50. In the exemplary embodiment, the slot 70 extends completely through a thickness of the side wall 52. Specifically, the slot 70 extends through opposite side surfaces 74 and 76 of the side wall 52 and completely through the side wall 52 therebetween. Alternatively, the slot 70 extends through only a portion of the thickness of the side wall 52. For example, the slot 70 may alternatively extend a depth through the side surface 74 and only partially through the thickness of the side wall 52, such that the slot 70 does not extend through the side surface 76 of the side wall 52. The slot 70 is shown herein as including a rectangular cross-sectional shape. In addition or alternatively, the slot 70 may include any other shape for cooperation with a keying member having any shape.

The extension 72 of the keying element 66*b* extends from the side surface 74 of the side wall 52 into the opening 18. The extension 72 extends a length into the opening 18 from the side surface 74 of the side wall 52 to an end 78. The extension 72 extends from the side surface 74 of the side wall 52 at a location on the side wall 52 that is closer to the edge 64 of the side wall 50 than to the edge 56 of the latch wall 46. In the exemplary embodiment, a front surface 80 of the extension 72 is recessed into the opening 18 relative to the front face 40 of the housing 12. Alternatively, the front surface 80 of the extension 72 extends coplanar with the front face 40 or is spaced from the front face 40 in a direction away from the terminating end 16 of the housing 12. In the exemplary embodiment, the extension 72 includes a rectangular cross-sectional shape, however, in addition or alternatively the extension 72 may include any other shape for cooperation with a keying member 68 having any shape.

The housing 12 of the receptacle connector 10 can be provided with a variety of different configurations of the keying elements 66, depending on the number, size, shape, location, and/or the like of each of the keying elements 66. Each different configuration of keying elements 66 provides a receptacle connector that is configured to receive a correspondingly differently configured plug connector therein. For example, FIGS. 3-7 are front elevational views of a plurality of exemplary alternative embodiments of receptacle connector housings 212, 312, 412, 512, and 612, respectively, having a plurality of different exemplary alternative configurations of respective keying elements 266, 366, 466, 566, and 666. Specifically, and referring now to FIG. 3, the receptacle connector housing 212 includes an opening 218, which extends through a front face 240 of a mating end 214 of the housing 212. The opening 218 is defined by a latch wall 246 and three side walls 248, 250, and 252. The latch wall 246 extends an interior width between a pair of opposite interior edges 256 and 258. The side wall 248 extends an interior width from the edge 258 of the latch wall 246 to an edge 262. The side wall 250 extends an interior width from the edge 262 to an edge 264. The side wall 252 extends an interior width from the edge 264 to the edge 256 of the latch wall 246.

In the exemplary embodiment, the housing 212 includes two keying elements 266*a* and 266*b*. Specifically, the side wall 252 of the housing 212 includes the keying element 266*a*, and the side wall 248 of the housing 212 includes the keying element 266*b*. The keying element 266*a* includes a slot 270 that extends into the side wall 252. The slot 270 extends within the side wall 252 at a location along the side wall 252 that is closer to the edge 256 of the latch wall 246 than to the edge 264 of the side wall 250. The keying element 266*b* includes an extension 272 that extends from a side surface 275 of the side wall 248 into the opening 218. The extension 272 extends from the side surface 275 of the side wall 248 at a location along the side wall 248 that is closer to the edge 262 of the side wall 248 than to the edge 258 of the latch wall 246.

Figure 4:
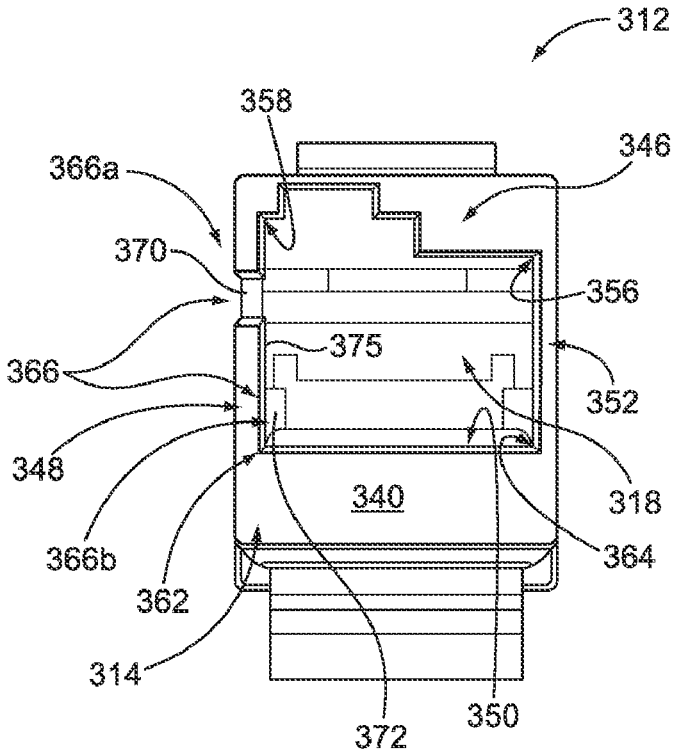
FIG. 4 is a front elevational view of an exemplary alternative embodiment of a receptacle connector housing illustrating an exemplary alternative configuration of keying elements.

Referring now to FIG. 4, the receptacle connector housing 312 includes an opening 318, which extends through a front face 340 of a mating end 314 of the housing 312. The opening 318 is defined by a latch wall 346 and three side walls 348, 350, and 352. The latch wall 346 extends an interior width between a pair of opposite interior edges 356 and 358. The side wall 348 extends an interior width from the edge 356 of the latch wall 346 to an interior edge 362. The side wall 350 extends an interior width from the edge 362 to an interior edge 364. The side wall 352 extends an interior width from the edge 364 to the edge 356 of the latch wall 346. In the exemplary embodiment, the housing 312 includes two keying elements 366*a* and 366*b*. Specifically, the side wall 348 of the housing 312 includes the keying elements 366*a* and 366*b*. The keying element 366*a* includes a slot 370 that extends into the side wall 348. The slot 370 extends within the side wall 348 at a location along the side wall 348 that is closer to the edge 358 of the latch wall 346 than to the edge 362 of the side wall 348. The keying element 366*b* includes an extension 372 that extends from a side surface 375 of the side wall 348 into the opening 318. The extension 372 extends from the side surface 375 of the side wall 348 at a location on the side wall 348 that is closer to the edge 362 of the side wall 348 than to the edge 358 of the latch wall 346.

Figure 5:
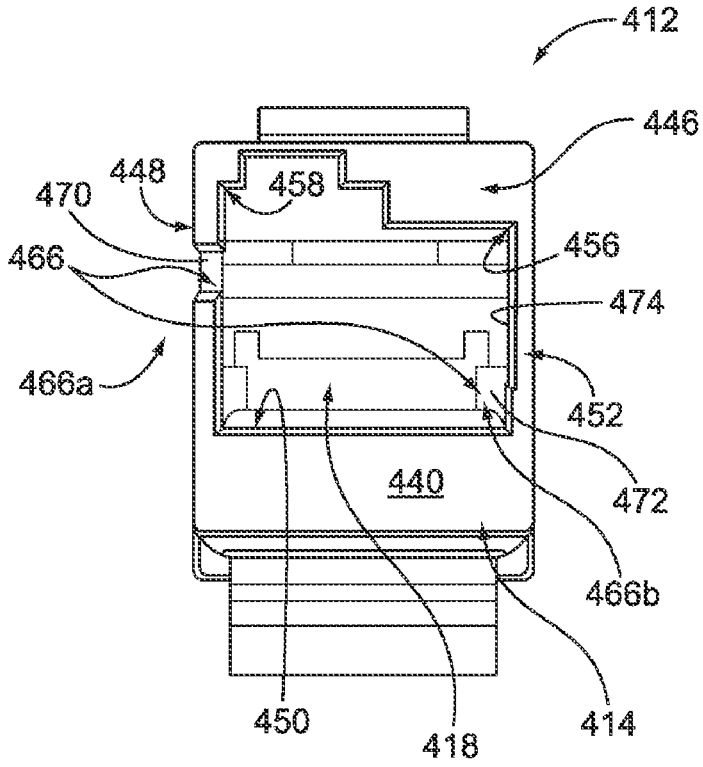
FIG. 5 is a front elevational view of an exemplary alternative embodiment of a receptacle connector housing illustrating an exemplary alternative configuration of keying elements.

Referring now to FIG. 5, the receptacle connector housing 412 includes an opening 418, which extends through a front face 440 of a mating end 414 of the housing 412. The opening 418 is defined by a latch wall 446 and three side walls 448, 450, and 452. The latch wall 446 extends an interior width between a pair of opposite interior edges 456 and 458. The side wall 448 extends an interior width from the edge 458 of the latch wall 446 to an interior edge 462. The side wall 450 extends an interior width from the edge 462 to an interior edge 464. The side wall 452 extends an interior width from the edge 464 to the edge 456 of the latch wall 446. In the exemplary embodiment, the housing 412 includes two keying elements 466*a* and 466*b*. Specifically, the side wall 448 of the housing 412 includes the keying element 466*a*, and the side wall 452 of the housing 412 includes the keying element 466*b*. The keying element 466*a* includes a slot 470 that extends into the side wall 448. The slot 470 extends into the side wall 448 at a location on the side wall 448 that is closer to the edge 458 of the latch wall 446 than to the edge 462 of the side wall 448. The keying element 466*b* includes an extension 472 that extends from a side surface 474 of the side wall 452 into the opening 418. The extension 472 extends from the side surface 474 of the side wall 452 at a location along the side wall 452 that is closer to the edge 464 of the side wall 450 than to the edge 456 of the latch wall 446.

Figure 6:
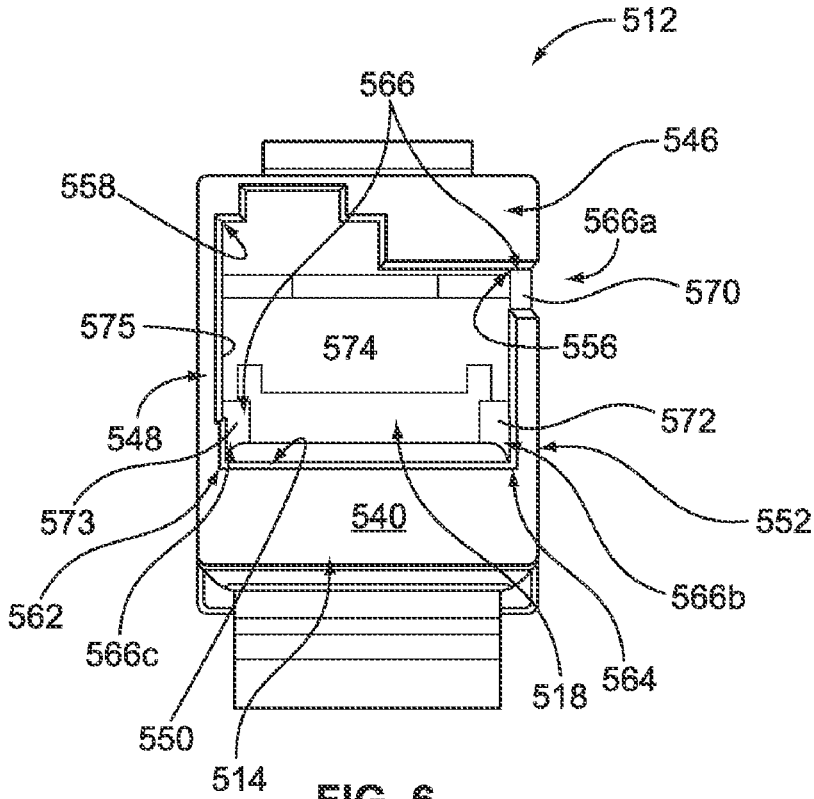
FIG. 6 is a front elevational view of an exemplary alternative embodiment of a receptacle connector housing illustrating an exemplary alternative configuration of keying elements.

Referring now to FIG. 6, the receptacle connector housing 512 includes an opening 518, which extends through a front face 540 of a mating end 514 of the housing 512. The opening 518 is defined by a latch wall 546 and three side walls 548, 550, and 552. The latch wall 546 extends an interior width between a pair of opposite interior edges 556 and 558. The side wall 548 extends an interior width from the edge 558 of the latch wall 546 to an interior edge 562. The side wall 550 extends an interior width from the edge 562 to an interior edge 564. The side wall 552 extends an interior width from the edge 564 to the edge 556 of the latch wall 546. In the exemplary embodiment, the housing 512 includes three keying elements 566*a*, 566*b*, and 566*c*. Specifically, the side wall 552 of the housing 512 includes the keying elements 566*a* and 566*b*, and the side wall 548 of the housing 512 includes the keying element 566*c*. The keying element 566*a* includes a slot 570 that extends into the side wall 552. The slot 570 extends within the side wall 552 at a location along the side wall 552 that is closer to the edge 556 of the latch wall 546 than to the edge 564 of the side wall 550. The keying element 566*b* includes an extension 572 that extends from a side surface 574 of the side wall 552 into the opening 518. The extension 572 extends from the side surface 574 of the side wall 552 at a location on the side wall 552 that is closer to the edge 564 of the side wall 550 than to the edge 556 of the latch wall 546. The keying element 566*c* includes an extension 573 that extends from a side surface 575 of the side wall 548 into the opening 518. The extension 573 extends from the side surface 575 of the side wall 548 at a location along the side wall 548 that is closer to the edge 562 of the side wall 548 than to the edge 558 of the latch wall 546.

Figure 7:
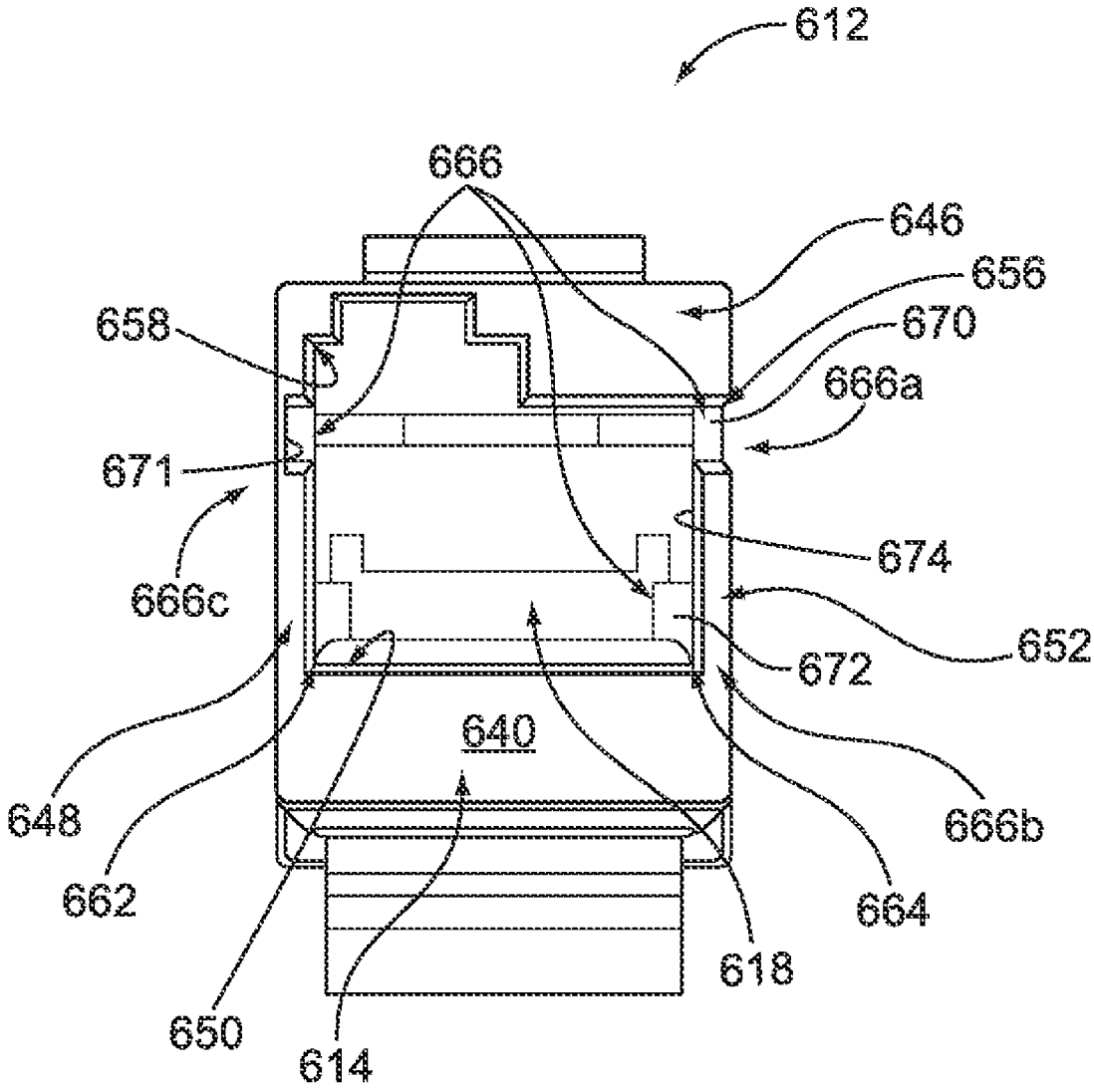
FIG. 7 is a front elevational view of an exemplary alternative embodiment of a receptacle connector housing illustrating an exemplary alternative configuration of keying elements.

Referring now to FIG. 7, the receptacle connector housing 612 includes an opening 618, which extends through a front face 640 of a mating end 614 of the housing 612. The opening 618 is defined by a latch wall 646 and three side walls 648, 650, and 652. The latch wall 646 extends an interior width between a pair of opposite interior edges 656 and 658. The side wall 648 extends an interior width from the edge 658 of the latch wall 646 to an interior edge 662. The side wall 650 extends an interior width from the edge 662 to an interior edge 664. The side wall 652 extends an interior width from the edge 664 to the edge 658 of the latch wall 646. In the exemplary embodiment, the housing 612 includes three keying elements 666*a*, 666*b*, and 666*c*. Specifically, the side wall 652 of the housing 612 includes the keying elements 666*a* and 666*b*, and the side wall 648 of the housing 612 includes the keying element 666*c*. The keying element 666*a* includes a slot 670 that extends into the side wall 652. The slot 670 extends into the side wall 652 at a location on the side wall 652 that is closer to the edge 656 of the latch wall 646 than to the edge 664 of the side wall 650. The keying element 666*b* includes an extension 672 that extends from a side surface 674 of the side wall 652 into the opening 618. The extension 672 extends from the side surface 674 of the side wall 652 at a location along the side wall 652 that is closer to the edge 664 of the side wall 650 than to the edge 656 of the latch wall 646. The keying element 666*c* includes a slot 671 that extends into the side wall 648. The slot 671 extends into the side wall 648 at a location on the side wall 648 that is closer to the edge 658 of the latch wall 646 than to the edge 662 of the side wall 650.

Figure 8:
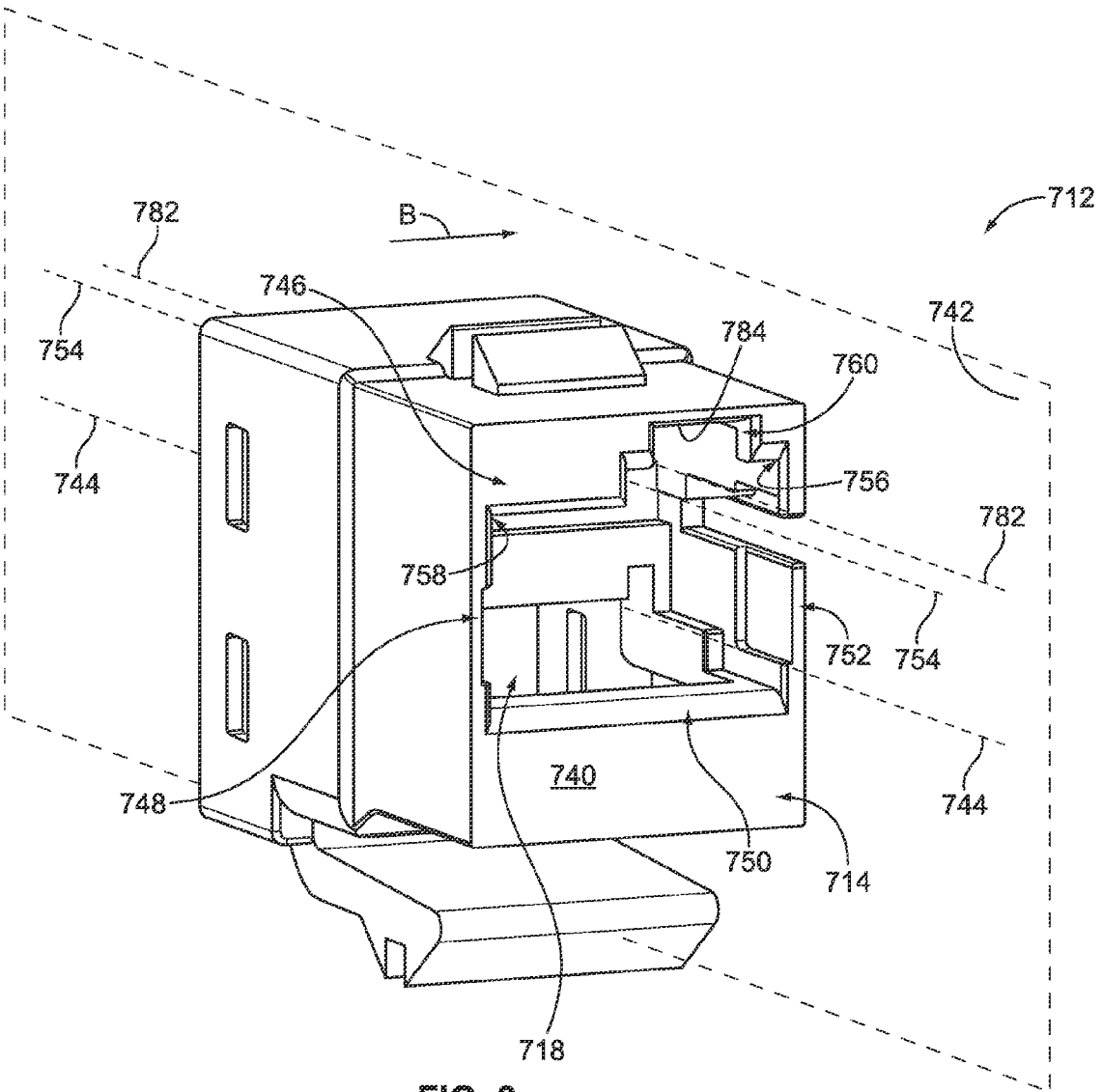
FIG. 8 is perspective view of an exemplary alternative embodiment of a receptacle connector housing illustrating an exemplary alternative embodiment of a latch element that is offset in an opposite direction to the latch element shown in FIG. 2.

FIG. 8 is perspective view of an exemplary alternative embodiment of a receptacle connector housing 712 illustrating an exemplary alternative embodiment of a latch element 760 being offset in an opposite direction to the latch element 60 (FIG. 2). The housing 712 includes a mating end 714 having a front face 740 through which an opening 718 extends. The opening 718 extends a length through the housing 712 along a central longitudinal plane 742 and along a central longitudinal axis 744 that lies within, and extends parallel to, the central longitudinal plane 742. The opening 718 is defined by a latch wall 746 and three side walls 748, 750, and 752. In the exemplary embodiment, the latch wall 746 extends a length from the front face 740 to a terminating end 716 of the housing 712. The latch wall 746 extends the length into the housing 712 along a central longitudinal axis 754, which may be referred to herein as a "central longitudinal latch wall axis". The latch wall 746 extends an interior width between a pair of opposite interior edges 756 and 758.

The latch wall 746 includes the latch element 760, which extends a length along a central longitudinal axis 782. In the exemplary embodiment, the central longitudinal axis 782 of the latch element 760 extends approximately parallel to the central longitudinal axis 754 of the latch wall 746. The latch element 760 is exposed within the opening 718. In the exemplary embodiment, the latch element 760 includes a slot 784 that extends within the latch wall 746 and is exposed within the opening 718. Specifically, the slot 784 extends a length, along the central longitudinal axis 782 thereof, through the front face 740 and into the latch wall 746 toward the terminating end 716 of the housing 712. As can be seen in FIG. 8, the central longitudinal axis 782 of the slot 784 is offset along the latch wall 746 from the central longitudinal axis 754 of the latch wall 746. Specifically, in the exemplary embodiment, the central longitudinal axis 782 of the slot 784 is offset from the central longitudinal axis 754 of the latch wall 746 along the interior width of the latch wall 746 in the direction of the arrow B. In other words, the central longitudinal axis 782 of the slot 784 is offset along the latch wall 746 from the central longitudinal plane 742 of the opening 718, in the direction B, such that the central longitudinal axis 782 of the slot 784 extends closer to the edge 756 of the latch wall 746 than to the edge 758 of the latch wall 746. The central longitudinal axis 782 of the latch element 760 may be referred to herein as a "central longitudinal latch element axis".

Figure 9:
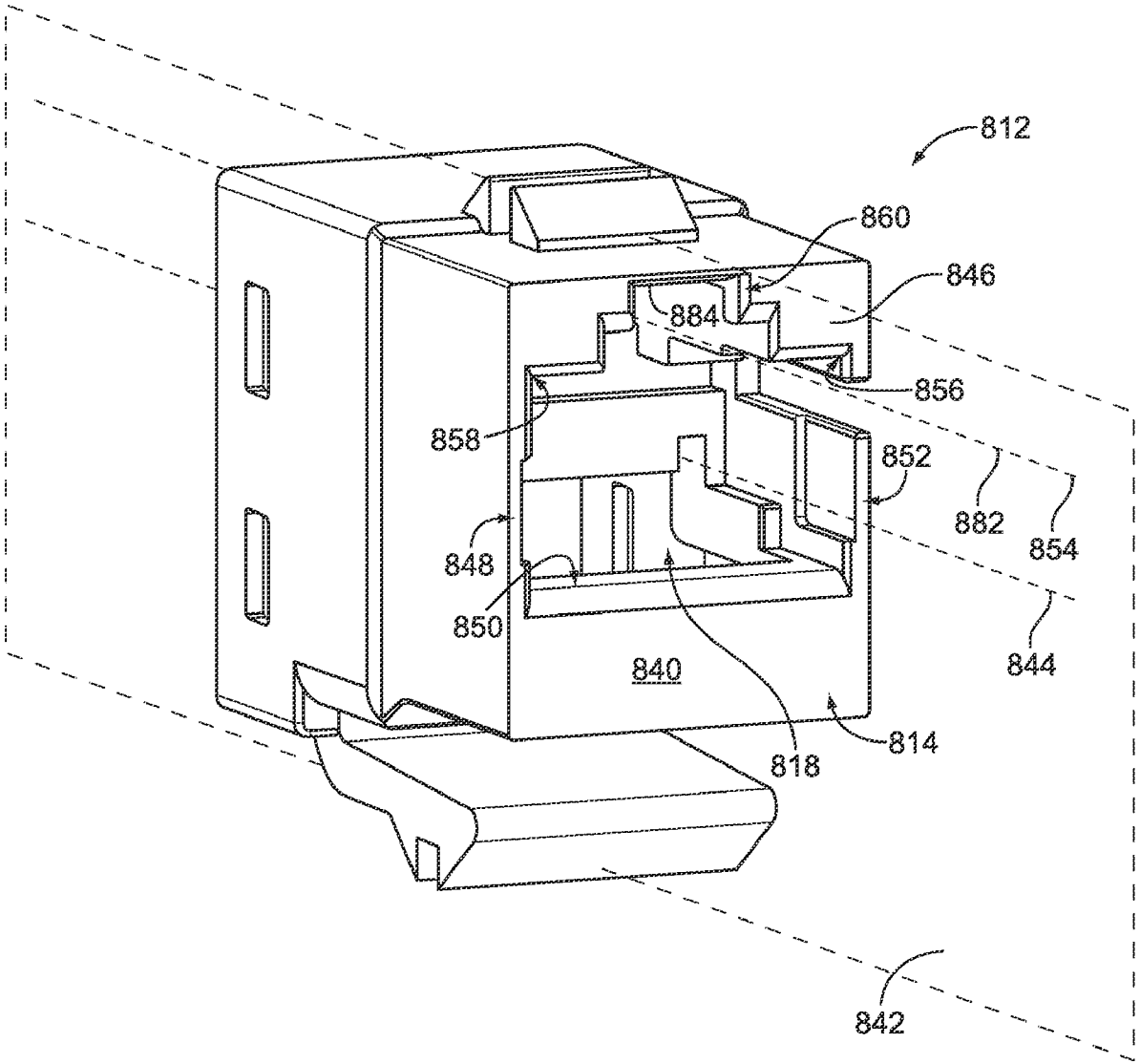
FIG. 9 is perspective view of an exemplary alternative embodiment of a receptacle connector housing illustrating an exemplary alternative embodiment of a latch element that is not offset from central longitudinal axis of a latch wall.

FIG. 9 is perspective view of an exemplary alternative embodiment of a receptacle connector housing 812 illustrating an exemplary alternative embodiment of a latch element 860 that is not offset from a central longitudinal axis 854 of a latch wall 846. The housing 812 includes a mating end 814 having a front face 840 through which an opening 818 extends. The opening 818 extends a length through the housing 812 along a central longitudinal plane 842 and along a central longitudinal axis 844 that lies within, and extends parallel to, the central longitudinal plane 842. The opening 818 is defined by the latch wall 846 and three side walls 848, 850, and 852. In the exemplary embodiment, the latch wall 846 extends a length from the front face 840 to a terminating end 816 of the housing 812. The latch wall 846 extends the length into the housing 812 along the central longitudinal axis 854, which may be referred to herein as a "central longitudinal latch wall axis". The latch wall 846 extends an interior width between a pair of opposite interior edges 856 and 858.

The latch wall 846 includes a latch element 860, which extends a length along a central longitudinal axis 882. In the exemplary embodiment, the central longitudinal axis 882 of the latch element 860 extends approximately parallel to the central longitudinal axis 854 of the latch wall 846. The latch element 860 is exposed within the opening 818. In the exemplary embodiment, the latch element 860 includes a slot 884 that extends within the latch wall 846 and is exposed within the opening 818. Specifically, the slot 884 extends a length, along the central longitudinal axis 882 thereof, through the front face 840 and into the latch wall 846 toward the terminating end 816 of the housing 812. As can be seen in FIG. 9, the central longitudinal axis 882 of the slot 884 is aligned with the central longitudinal axis 854 of the latch wall 846 such that the central longitudinal axis 882 of the slot 884 is not offset from the central longitudinal axis 854 of the latch wall 846. Accordingly, the central longitudinal axis 882 of the slot 884 extends approximately an equal distance from each of the edges 856 and 858 of the latch wall 846. The central longitudinal axis 882 of the latch element 860 may be referred to herein as a "central longitudinal latch element axis".

FIG. 10 is perspective view of an exemplary embodiment of the plug connector 110. In the exemplary embodiment, the plug connector 110 is a modular connector, such as, but not limited to, an RJ-45 plug. However, the plug connector 110 may be any other type of plug connector. The plug connector 110 includes a housing 112 extending from a length from a mating end 114 to a terminating end 116. The mating end 114 includes a front face 140. The length of the housing 112 extends along a central longitudinal plane 142 and along a central longitudinal axis 144 that lies within, and extends parallel to, the central longitudinal plane 142. The mating end 114 of the housing 112 defines a plug 113 that is configured to be received within the opening 18 (FIGS. 1 and 2) of the receptacle connector 10 (FIG. 1). The plug 113 is defined by one or more walls of the housing 112. In the exemplary embodiment, the plug 113 is defined by a latch wall 146 and three side walls 148, 150, and 152. The latch wall 146 extends a length along a central longitudinal axis 154 from the front face 140 to the terminating end 116 of the housing 112. The latch wall 146 extends an exterior width $W_1$ between a pair of opposite exterior edges 156 and 158. Specifically, the latch wall 146 extends the width $W_1$ from the edge 156 to the edge 158. Each of the side walls 148, 150, and 152 extends a length from the front face 140 to the terminating end 116 of the housing 112. The side wall 148 extends an exterior width from the edge 158 of the latch wall 146 to an exterior edge 162. The side wall 150 extends an exterior width from the edge 162 to an exterior edge 164. The side wall 152 extends an exterior width from the edge 164 to the edge 156 of the latch wall 146. In the exemplary embodiment, the plug 113 is defined by the four walls 146, 148, 150, and 152 such that the plug 113 generally includes a rectangular shape. In addition or alternatively to the rectangular shape, the plug 113 may include any other shape for being received within any shaped opening (such as, but not limited to, the opening 18 of the receptacle connector 10, and/or the like) therein. Moreover, in the exemplary embodiment, the walls 146 and 150 extend approximately parallel to each other, the walls 148 and 152 extend approximately parallel to each other, and the walls 146 and 150 extend approximately perpendicular to the walls 148 and 152. Alternatively, each of the walls 146, 148, 150, and 152 extend at any other angle relative to each of the other walls 146, 148, 150, and 152. The central longitudinal axis 154 of the latch wall 146 may be referred to herein as a "central longitudinal latch wall axis".

The housing 112 holds an array 130 of a plurality of electrical contacts 132. In the exemplary embodiment, the side wall 50 of the housing 112 includes a plurality of channels 115 extending therein and through the front face 140 of the housing 112. Each electrical contact 132 within the array 130 includes a mating interface 134 exposed within a corresponding one of the channels 115. Each mating interface 134 engages the corresponding electrical contact 32 (FIG. 1) of the receptacle connector 10 when the plug connector 110 is mated with the receptacle connector 10. The arrangement of the electrical contacts 132 may be controlled by industry standards, such as, but not limited to, IEC 60603-7. In an exemplary embodiment, the plug connector 110 includes eight electrical contacts 132 arranged as differential pairs. However, the plug connector 110 may include any number of electrical contacts 132, whether or not the electrical contacts 132 are arranged in differential pairs.

In the exemplary embodiment, the plug connector 110 terminates the end of a cable 139. Specifically, a plurality of wires (not shown) is electrically connected to the electrical contacts 132. In the exemplary embodiment, eight wires arranged as differential pairs are terminated to the plug connector 110. However, any number of wires may be terminated to the plug connector 110, whether or not the wires are arranged in differential pairs. The plug connector 110 provides electrical signal, electrical ground, and/or electrical power paths between the receptacle connector 10 and the wires of the cable 139 via the electrical contacts 132. Alternatively, the plug connector 110 is mounted on, and electrically connected to, a circuit board (not shown).

The housing 112 of the plug connector 110 includes one or more of the optional keying members 68 that cooperate with the keying elements 66 (FIG. 2) of the receptacle connector 10. The keying members 68 facilitate providing discriminating access to the plug connector 110. Specifically, the keying members 68 facilitate preventing some receptacle connectors from mating with the plug connector 110. In other words, only some receptacle connectors can fully receive the plug 113 and electrically connect to the electrical contacts 132. For example, the keying members 68 may prevent receptacle connectors having keying elements that are not complementary with the keying members 68 of the plug connector 110 (e.g., keying elements having different sizes, shapes, locations, and/or the like relative to the keying members 68) from fully receiving the plug 113 and electrically connecting to the electrical contacts 132. Receptacle connectors having keying elements that are complementarily sized, shaped, located, and/or the like relative to the keying members 68 can fully receive the plug 113 and electrically connected to the electrical contacts 132.

The plug connector housing 112 includes two keying members 68*a* and 68*b* in the exemplary embodiment. However, the plug connector housing 112 may include any number of the keying members 68. In the exemplary embodiment, the side wall 148 of the housing 112 includes the keying member 68*a* and the keying member 68*b*. Specifically, the keying member 68*a* includes an extension 170 that extends from the side wall 148, and the keying member 68*b* includes a slot 172 that extends into the side wall 148. The extension 170 of the keying member 68*a* is configured to be received within the slot 70 (FIG. 2) of the receptacle connector 10 and extends from a side surface 174 of the side wall 148. The extension 170 extends a length from the side surface 174 to an end 178. The extension 170 extends from the side surface 174 of the side wall 148 at a location on the side wall 148 that is closer to the edge 158 of the latch wall 146 than to the edge 162 of the side wall 148. In the exemplary embodiment, a front surface 180 of the extension 170 is recessed relative to the front face 140 of the housing 112. Alternatively, the front surface 180 of the extension 170 extends coplanar with the front face 140 or is spaced from the front face 140 in a direction away from the terminating end 116 of the housing 112. In the exemplary embodiment, the extension 170 includes a rectangular cross-sectional shape, however, in addition or alternatively the extension 170 may include any other shape for cooperation with a keying element having any shape.

The slot 172 of the keying member 68*b* is configured to receive the extension 72 (FIG. 2) of the receptacle connector 10. The slot 172 extends a length, along the central longitudinal axis 144 of the housing 112, through the front face 140 and into the side wall 148 toward the terminating end 116 of the housing 112. The length of the slot 172 extends into the side wall 148 at a location on the side wall 148 that is closer to the edge 162 of the side wall 148 than to the edge 158 of the latch wall 146. The slot 172 is shown herein as including a rectangular cross-sectional shape. In addition or alternatively, the slot 172 may include any other shape for cooperation with a keying element having any shape.

The housing 112 of the plug connector 110 can be provided with a variety of different configurations of the keying members 68, depending on the number, size, shape, location, and/or the like of each of the keying members 68. Each different configuration of keying members 68 provides a plug connector that is configured to be received within a differently configured receptacle connector. For example, the extension 170 may be located as shown in FIG. 2 while the slot 172 extends within the side wall 152 at a location that is closer to the edge 164 of the side wall 150 than to the edge 156 of the latch wall 146, such that the plug 113 is configured to mate with the receptacle connector housing 212 shown in FIG. 3. Moreover, and for example, the extension 170 and the slot 172 may each be located on the side wall 152 of the plug 113, such that the plug 113 is configured to mate with the receptacle connector housing 312 shown in FIG. 4. Another example includes locating the extension 170 on side wall 148 and the slot 172 on the side wall 152 such that the plug 113 is configured to mate with the receptacle connector housing 412 shown in FIG. 5. Yet another example includes locating the extension 170 and the slot 172 on the side wall 148 as shown in FIG. 2, and including another extension (not shown) on the side wall 152 such that the plug 113 is configured to mate with the receptacle connector housing 512 shown in FIG. 6. Even another example includes locating the extension 170 and the slot 172 on the side wall 148 as shown in FIG. 2, and including another slot (not shown) on the side wall 152 such that the plug 113 is configured to mate with the receptacle connector housing 612 shown in FIG. 7.

The latch wall 146 includes the latch member 160, which extends a length along a central longitudinal axis 182. In the exemplary embodiment, the central longitudinal axis 182 of the latch member 160 extends approximately parallel to the central longitudinal axis 154 of the latch wall 146. Alternatively, the central longitudinal axis 182 extends at any other angle relative to the central longitudinal axis 154 of the latch wall 146. The latch element 160 is exposed on the latch wall 146. In the exemplary embodiment, the latch member 160 includes a latch lever 184 that extends outwardly from the latch wall 146. Specifically, the latch lever 184 extends a length, along the central longitudinal axis 182 thereof, from a latch wall end 185 to a free end 187. In the exemplary embodiment, the latch lever 184 includes a pair of shoulders 186. Each shoulder 186 engages a corresponding one of the ledges 86 (FIG. 2) of the latch element 60 (FIG. 2) of the receptacle connector 10 to latch the connectors 10 and 110 together. Specifically, each shoulder 186 includes a latching surface 188 that engages a corresponding latching surface 88 (FIG. 1) of the latch element 60. Although two shoulders 186 are shown, the latch lever 184 may include any number of shoulders 186 for engaging any number of ledges 86 of the receptacle connector 10. In addition or alternative to the latch lever 184, the latch member 160 may include any other structure and/or the like, such as, but not limited to, a slot (not shown) extending into the latch wall 146, and/or the like. The central longitudinal axis 182 of the latch member 160 may be referred to herein as a "central longitudinal latch member axis".

The central longitudinal axis 182 of the latch lever 184 is offset along the latch wall 146 from the central longitudinal axis 154 of the latch wall 146. Specifically, in the exemplary embodiment, the central longitudinal axis 182 of the latch lever 184 is offset from the central longitudinal axis 154 of the latch wall 146 along the exterior width of the latch wall 146 in the direction of the arrow C. In other words, the central longitudinal axis 182 of the latch lever 184 is offset along the latch wall 146 from the central longitudinal plane 142 of the housing 112, in the direction C, such that the central longitudinal axis 182 of the latch lever 184 extends closer to one of the edges 156 or 158 of the latch wall 146 than to the other edge 156 or 158. In the exemplary embodiment of FIG. 10, the central longitudinal axis 182 of the latch lever 184 extends closer to the edge 156 of the latch wall 146 than to the edge 158 of the latch wall 146.

Referring now to FIGS. 2 and 10, to mate the receptacle connector 10 and the plug connector 110 together, the housings 12 and 112 are moved toward each other along the mating direction M (FIG. 1). The plug 113 of the plug connector housing 112 is received within the opening 18 of the receptacle connector housing 12. The extension 170 of the plug connector housing 112 is received within the slot 70 of the receptacle connector housing 12. Similarly, the extension 72 of the receptacle connector housing 12 is received within the slot 172 of the plug connector housing 112. The latch lever 184 of the plug connector housing 112 is received within the slot 84 of the latch wall 46 of the receptacle connector housing 12. The latching surface 188 of each shoulder 186 of the latch lever 184 is engaged with the latching surface 88 of the corresponding ledge 86 of the slot 84 such that the connectors 10 and 110 are latched together. When latched together, the free end 187 of the latch lever 184 is exposed from the slot 84 such that the free end 187 can be pressed toward the latch wall 146 of the plug connector housing 112 to disengage the shoulders 186 and ledges 86 and thereby unlatch the connectors 10 and 110.

Figure 11:
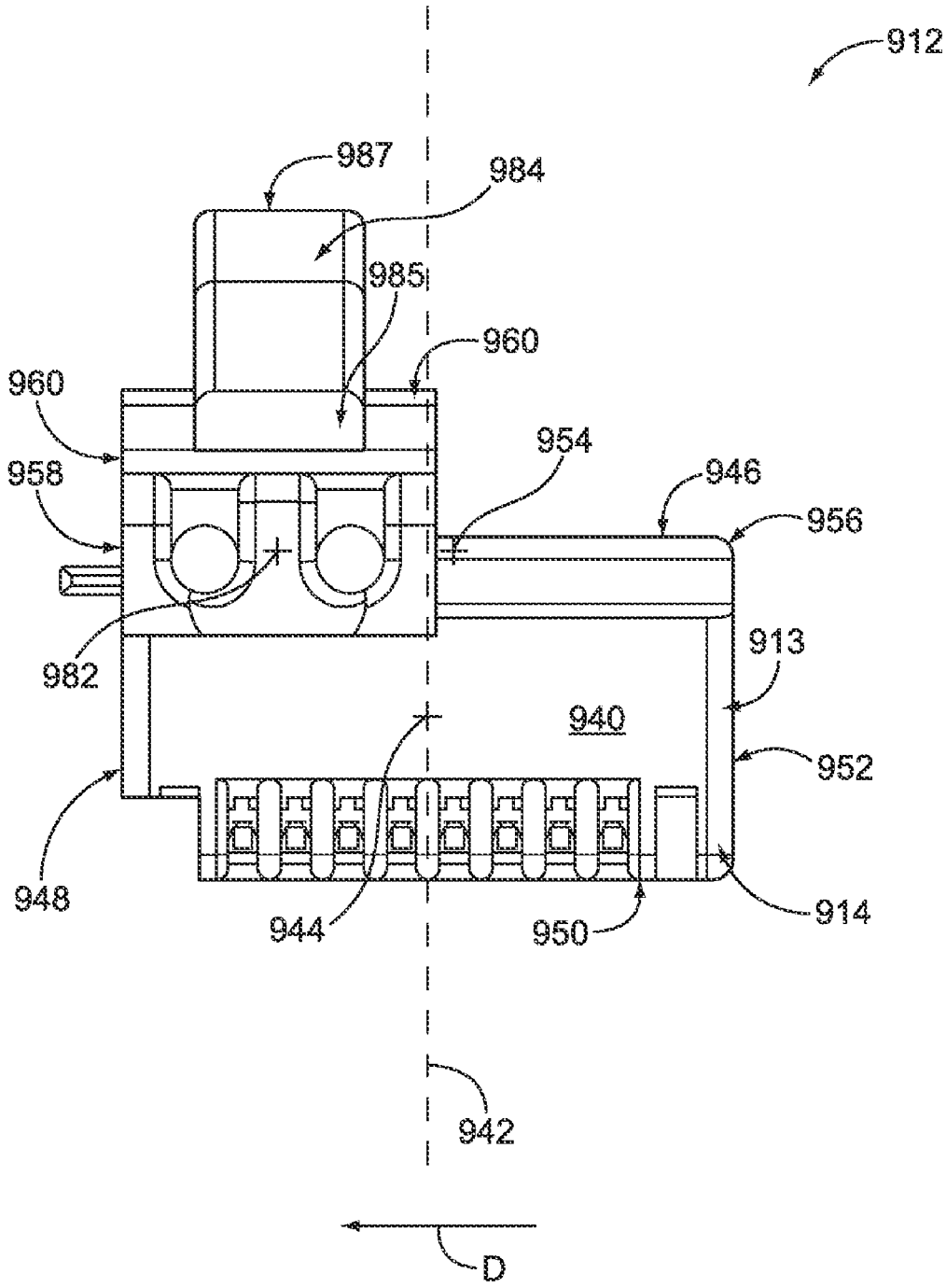
FIG. 11 is a front elevational view of an exemplary alternative embodiment of a plug connector housing illustrating an exemplary alternative embodiment of a latch member that is offset in an opposite direction to the latch member shown in FIG. 10.

FIG. 11 is perspective view of an exemplary alternative embodiment of a plug connector housing 912 illustrating an exemplary alternative embodiment of a latch member 960 that is offset in an opposite direction to the latch member 160 (FIG. 10). The housing 912 extends a length from a mating end 914 to a terminating end (not shown). The mating end 914 includes a front face 940. The length of the housing 912 extends along a central longitudinal plane 942 and along a central longitudinal axis 944 that lies within, and extends parallel to, the central longitudinal plane 942. The mating end 914 of the housing 912 defines a plug 913 that is configured to be received within the opening 718 (FIG. 8) of the receptacle connector housing 712 (FIG. 8). The plug 913 is defined by a latch wall 946 and three side walls 948, 950, and 952. In the exemplary embodiment, the latch wall 946 extends a length from the front face 940 to the terminating end 916 of the housing 912. The latch wall 946 extends the length along a central longitudinal axis 954, which may be referred to herein as a "central longitudinal latch wall axis". The latch wall 946 extends an exterior width between a pair of opposite edges 956 and 958.

The latch wall 946 includes a latch member 960, which extends a length along a central longitudinal axis 982. In the exemplary embodiment, the central longitudinal axis 982 of the latch member 960 extends approximately parallel to the central longitudinal axis 954 of the latch wall 946. In the exemplary embodiment, the latch member 960 includes a latch lever 984 that extends outwardly from the latch wall 946. The latch lever 984 extends a length, along the central longitudinal axis 982 thereof, from a latch wall end 985 to a free end 987. As can be seen in FIG. 11, the central longitudinal axis 982 of the latch lever 984 is offset along the latch wall 946 from the central longitudinal axis 954 of the latch wall 946. Specifically, in the exemplary embodiment, the central longitudinal axis 982 of the latch lever 984 is offset from the central longitudinal axis 954 of the latch wall 946 along the exterior width of the latch wall 946 in the direction of the arrow D. In other words, the central longitudinal axis 982 of the latch lever 984 is offset along the latch wall 946 from the central longitudinal plane 942 of the housing 912, in the direction D, such that the central longitudinal axis 982 of the latch lever 984 extends closer to the edge 958 of the latch wall 946 than to the edge 956 of the latch wall 946. The central longitudinal axis 982 of the latch member 960 may be referred to herein as a "central longitudinal latch member axis".

Figure 12:
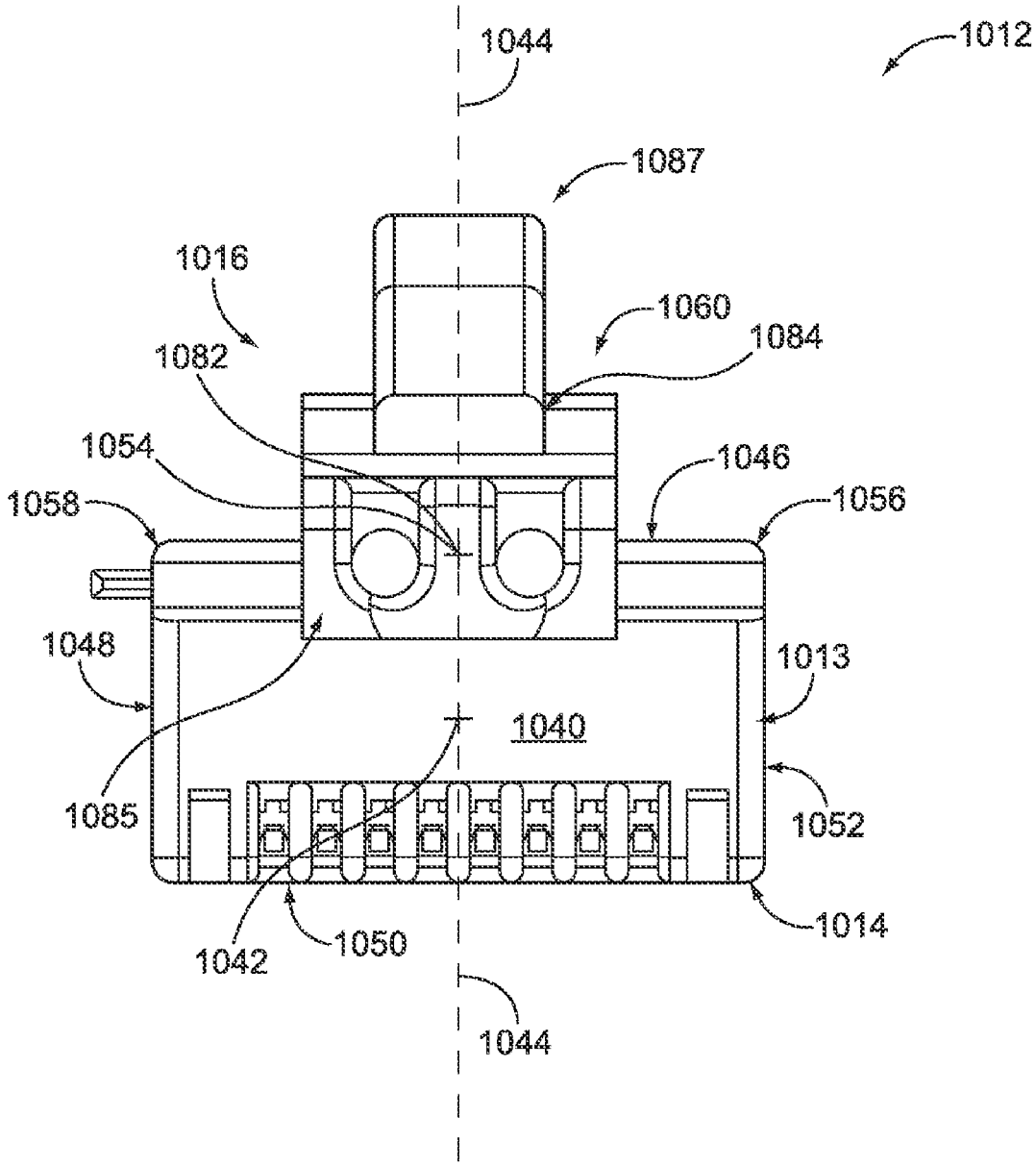
FIG. 12 is a front elevational view of an exemplary alternative embodiment of a plug connector housing illustrating an exemplary alternative embodiment of a latch member that is not offset from central longitudinal axis of a latch wall.

FIG. 12 is front elevational view of an exemplary alternative embodiment of a plug connector housing 1012 illustrating an exemplary alternative embodiment of a latch member 1060 that is not offset from a central longitudinal axis 1054 of a latch wall 1046. The housing 1012 extends a length from a mating end 1014 to a terminating end 1016. The mating end 1014 includes a front face 1040. The length of the housing 1012 extends along a central longitudinal plane 1042 and along a central longitudinal axis 1044 that lies within, and extends parallel to, the central longitudinal plane 1042. The mating end 1014 of the housing 1012 defines a plug 1013 that is configured to be received within the opening 818 (FIG. 9) of the receptacle connector housing 812 (FIG. 9). The plug 1013 is defined by a latch wall 1046 and three side walls 1048, 1050, and 1052. In the exemplary embodiment, the latch wall 1046 extends a length from the front face 1040 to the terminating end 1016 of the housing 1012. The latch wall 1046 extends the length along a central longitudinal axis 1054, which may be referred to herein as a "central longitudinal latch wall axis". The latch wall 1046 extends an exterior width between a pair of opposite edges 1056 and 1058.

The latch wall 1046 includes a latch member 1060, which extends a length along a central longitudinal axis 1082. In the exemplary embodiment, the central longitudinal axis 1082 of the latch member 1060 extends approximately parallel to the central longitudinal axis 1054 of the latch wall 1046. In the exemplary embodiment, the latch member 1060 includes a latch lever 1084 that extends outwardly from the latch wall 1046. The latch lever 1084 extends a length, along the central longitudinal axis 1082 thereof, from a latch wall end 1085 to a free end 1087. As can be seen in FIG. 12, the central longitudinal axis 1082 of the latch lever 1084 is aligned with the central longitudinal axis 1054 of the latch wall 1046 such that the central longitudinal axis 1082 of the latch lever 1084 is not offset from the central longitudinal axis 1054 of the latch wall 1046. Accordingly, the central longitudinal axis 1082 of the latch lever 1084 extends approximately an equal distance from each of the edges 1056 and 1058 of the latch wall 1046. The central longitudinal axis 1082 of the latch member 1060 may be referred to herein as a "central longitudinal latch member axis".

The embodiments described and/or illustrated herein may provide an electrical connector having a greater number of different configurations of keying features (e.g., keying elements and/or keying members) than at least some known electrical connectors. For example, by providing at least two additional positions of the latch elements and latch members on the latch wall, in addition to the central position shown in FIGS. 9 and 12, the embodiments described and/or illustrated herein may provide an electrical connector having three times the number of different configurations of keying features.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the elements/components/etc. The terms "comprising", "including" and "having" are intended to be inclusive and mean that there may be additional elements/components/etc. other than the listed elements/components/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A receptacle connector configured to mate with a plug connector having a latch member, said receptacle connector comprising:

a housing comprising a mating end, an opening extending into the housing through the mating end, and a latch wall, the opening being configured to receive the plug connector therein through the mating end of the housing, the opening being at least partially defined by the latch wall, the latch wall extending a length into the housing along a central longitudinal latch wall axis, the latch wall comprising a latch element extending a length along a central longitudinal latch element axis, the central longitudinal latch element axis being offset along the latch wall from the central longitudinal latch wall axis, the latch element exposed within the opening and cooperating with the latch member of the plug connector to latch the plug connector to the housing when the plug connector is received within the opening of the housing, wherein the housing comprises a side wall that extends from the latch wall and partially defines the opening within the housing, the side wall comprising a slot that extends completely through a thickness of the side wall; and a contact held within the housing, the contact having a mating interface exposed within the opening of the housing for electrically connecting to the plug connector when the plug connector is received within the opening of the housing.

2. The receptacle connector according to claim 1, wherein the latch wall extends an interior width, the central longitudinal latch element axis of the latch element being offset from the central longitudinal latch wall axis along the interior width of the latch wall.

3. The receptacle connector according to claim 1, wherein the latch wall extends an interior width between a pair of opposite edges, the central longitudinal latch element axis of the latch element extending closer to one of the edges of the latch wall than the other edge.

4. The receptacle connector according to claim 1, wherein the opening of the housing extends into the housing along a central longitudinal plane, the central longitudinal latch wall axis of the latch wall extending parallel to and within the central longitudinal plane of the opening, the central longitudinal latch element axis being offset along the latch wall from the central longitudinal plane of the opening.

5. The receptacle connector according to claim 1, wherein the central longitudinal latch element axis of the latch element extends approximately parallel to the central longitudinal latch wall axis of the latch wall.

6. The receptacle connector according to claim 1, wherein the housing comprises a front face at the mating end and the slot is a first slot, the latch element comprising a second slot extending within the latch wall, the second slot extending through the front face of the housing and extending a length along the central longitudinal latch element axis.

7. The receptacle connector according to claim 1, wherein the latch element comprises a ledge exposed within the opening of the housing, the ledge having a latching surface that engages the latch member of the plug connector when the plug connector is received within the opening of the housing.

8. The receptacle connector according to claim 1, wherein the housing comprises a keying element cooperating with a keying member of the plug connector when the plug connector is received within the opening of the housing.

9. The receptacle connector according to claim 1, wherein the side wall comprises a keying element cooperating with a keying member of the plug connector when the plug connector is received within the opening of the housing, the keying element comprising one of the slot and an extension extending from the side wall into the opening of the housing.

10. The receptacle connector according to claim 1, wherein the receptacle connector comprises an RJ-45 jack.

11. A plug connector configured to mate with a receptacle connector having a latch element, said plug connector comprising:

a housing comprising an RJ-45 plug having a latch wall, the plug configured to be received within the receptacle connector, the latch wall extending a length along a central longitudinal latch wall axis, the latch wall comprising a latch member extending a length along a central longitudinal latch member axis, the central longitudinal latch member axis being offset along the latch wall from the central longitudinal latch wall axis, the latch member cooperating with the latch element of the receptacle connector to latch the receptacle connector to the housing when the receptacle connector receives the plug therein; and a contact held by the housing, the contact having a mating interface extending along the plug of the housing for electrically connecting to the receptacle connector when the receptacle connector receives the plug therein.

12. The plug connector according to claim 11, wherein the latch wall extends an exterior width, the central longitudinal latch member axis of the latch member being offset from the central longitudinal latch wall axis along the exterior width of the latch wall.

13. The plug connector according to claim 11, wherein the latch wall extends an exterior width between a pair of opposite edges, the central longitudinal latch member axis of the latch member extending closer to one of the edges of the latch wall than the other edge.

14. The plug connector according to claim 11, wherein the housing extends a length along a central longitudinal plane, the central longitudinal latch wall axis of the latch wall extending parallel to and within the central longitudinal plane of the housing, the central longitudinal latch member axis being offset along the latch wall from the central longitudinal plane of the housing.

15. The plug connector according to claim 11, wherein the central longitudinal latch member axis of the latch member extends approximately parallel to the central longitudinal latch wall axis of the latch wall.

16. The plug connector according to claim 11, wherein the latch member comprises a latch lever extending outwardly from the latch wall from a latch wall end to a free end.

17. The plug connector according to claim 11, wherein the latch member comprises a latch lever extending outwardly from the latch wall, the latch lever comprising a shoulder, the shoulder having a latching surface that engages the latch element of the receptacle connector when the plug is received within the receptacle connector.

18. The plug connector according to claim 11, wherein the plug of the housing comprises a keying member, the keying member cooperating with a keying element of the receptacle connector when the plug is received within the receptacle connector.

19. The plug connector according to claim 11, wherein the plug of the housing comprises a side wall extending from the latch wall, the side wall comprising a keying member cooperating with a keying element of the receptacle connector when the plug is received within the receptacle connector, the keying member comprising one of a slot extending within the side wall and an extension extending from the side wall.

* * * * *